United States Patent [19]

Eskeli

[11] 3,939,661

[45] Feb. 24, 1976

[54] POWER GENERATOR

[76] Inventor: Michael Eskeli, 7994-41 Locke Lee, Houston, Tex. 77042

[22] Filed: Aug. 27, 1974

[21] Appl. No.: 501,064

Related U.S. Application Data

[63] Continuation-in-part of Ser. No. 386,273, Aug. 7, 1973, Pat. No. 3,879,152.

[52] U.S. Cl. ..... 60/682; 60/721; 415/68

[51] Int. Cl.[2] ..... F01K 27/00

[58] Field of Search ..... 415/60, 64, 66, 68; 60/643, 645, 650, 670, 682

[56] References Cited

UNITED STATES PATENTS 3,834,179 9/1974 Eskeli ..... 60/682 X

*Primary Examiner*—Allen M. Ostrager

*Attorney, Agent, or Firm*—R. W. Dickerson

[57] ABSTRACT

A method and apparatus for the generation of power wherein a fluid is circulated within a pressurizer wherein the fluid is pressurized by centrifugal action and then passed via nozzles to a toroidal shaped cavity for further pressurization. After passing through said circular shaped cavity, the fluid passes through nozzles oriented to discharge forward, in the direction of rotation, and then the fluid is passed through a reaction type turbine wheel with inward flow, to generate the power. Work is required to rotate the pressurizer, and work is obtained from the turbine, and the difference between the two amounts of work is the work output for the power generator. Heat is added to the working fluid of the power generator from external sources. Working fluid may be either a gas or a liquid. Normally, the working fluid is maintained within the power generator at an elevated pressure.

6 Claims, 3 Drawing Figures

POWER GENERATOR

This application is a continuation-in-part application of "Turbine", filed Aug. 7, 1973, Ser. No. 386,273, now U.S. Pat. No. 3,879,152.

BACKGROUND OF THE INVENTION

This invention relates to devices for generating power wherein a fluid is passed from a higher energy level to lower energy level by pressurizing the fluid first in a forced vortex type pressurizer section, and then further pressurizing said fluid in a free vortex type pressurizing section, and then passing said fluid into an inward flow turbine where said high pressure fluid pressure in decreased with accompanying generation of power. The temperature of the fluid is decreased when passing through the pressurizing and power generation sections and heat is then added to said fluid from external sources.

There have been various devices for generation of power; in some of these devices a fluid is passed through an inward flow turbine and the fluid is supplied to the rotor wheel from stationary nozzles at rotor periphery. These devices require for their operation a pressurized fluid source, and can not operate by using heat directly.

DESCRIPTION OF PREFERRED EMBODIMENTS

It is an object of this invention to provide for a power generator which can use heat from a suitable source to generate power. Further, it is an object of this invention to provide a power generator that is inexpensive and simple in construction and which can use ordinary materials for its construction.

Figure 1:
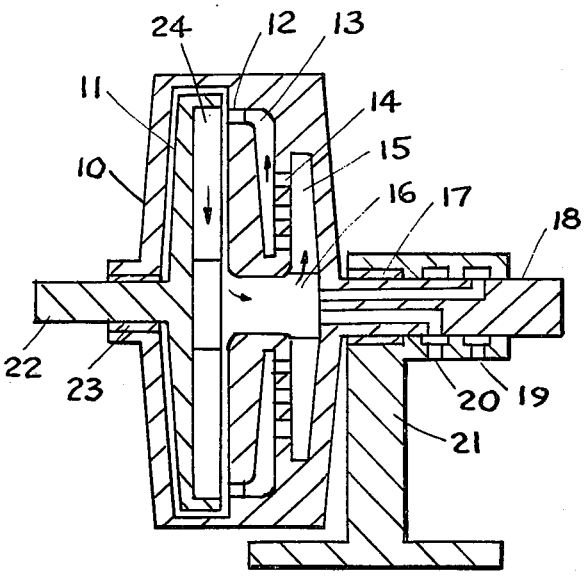
FIG. 1 is a cross section of the power generator.

In FIG. 1, a cross section parallel to the rotor shafts is shown. 10 is first rotor, 11 is second rotor, 24 are second rotor vanes, 12 are fluid nozzles discharging forward in the direction of rotation of both rotors, 13 is first rotor free vortex cavity, 14 are feeder nozzles discharging forward in the direction of rotation into said free vortex cavity, 15 are vanes in first rotor forced vortex cavity, 16 is fluid space near rotor center, 17 is first rotor shaft bearing, 18 is first rotor shaft, 19 and 20 are fluid entry and exit for passing the fluid to be heated in an external heater, 21 is support, 23 second rotor shaft bearing, 22 is second rotor shaft.

Figure 2:
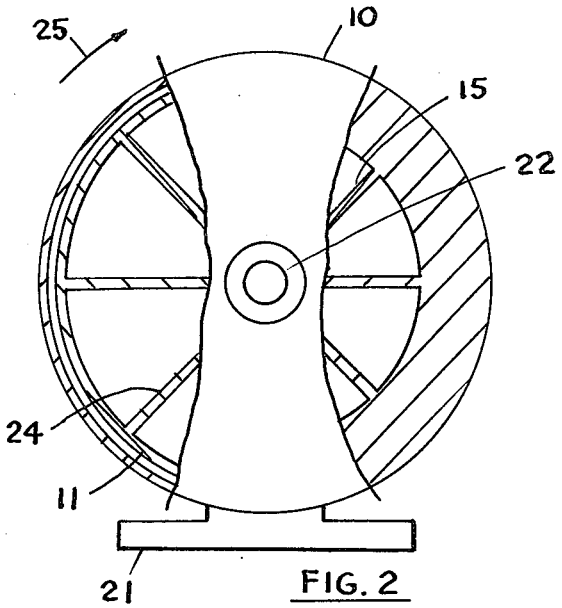
FIG. 2 is an end view of the power generator.

In FIG. 2, an end view of the unit is shown with sections removed to show unit interior details. 10 is first rotor, 15 are first rotor vanes, 22 is second rotor shaft, 21 is support, 11 is second rotor and 24 are second rotor vanes, and 25 indicates direction of rotation for both rotors.

Figure 3:
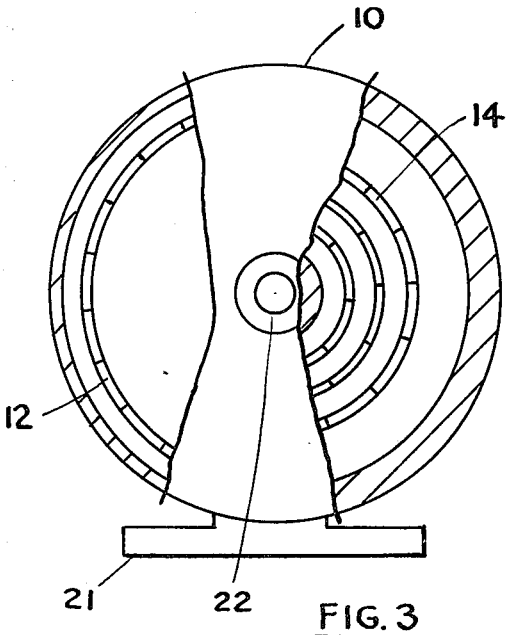
FIG. 3 is another end view of the power generator.

In FIG. 3, another end view of the unit is shown. 10 is first rotor, 14 are fluid feeder nozzles for passing said fluid into said free vortex cavity, 22 is second rotor shaft, 21 is support, 12 are fluid nozzles for discharging said fluid from first rotor and passing said fluid into said second rotor.

Figure 4:
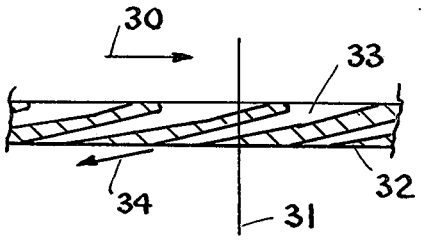
FIG. 4 is a detail of nozzles.

In FIG. 4, a detail of the nozzles used with this device is shown. 30 indicates direction of rotation of the nozzle wall 32 around shaft 31. 33 are said nozzles, and 34 indicates fluid leaving said nozzles.

In operation, said fluid is passed from center area 16 to forced vortex cavity of said first rotor 10, and there pressurized by centrifugal action on said fluid by said first rotor with vanes 15 assuring that said fluid will rotate at the same speed as said rotor. After such pressurization, said fluid is passed through feeder nozzles 14 into said free vortex cavity 13, with said fluid being oriented to leave said nozzles 14 in a forward direction so that the tangential velocity of the fluid leaving said nozzles relative to the rotor is added to the tangential velocity of said first rotor in the area where said nozzle is located. Thus, the said fluid will have a high tangential velocity, and since said fluid is forced to move along a curved path formed by said free vortex cavity, the fluid will form a free vortex. The pressure of said fluid is then increased toward the periphery of said free vortex cavity 13 in accordance with well known rules pertaining to free vortexes. The high pressure fluid is then discharged via nozzles 12 in a forward direction that is in the direction of rotation, and the said fluid then enters said second rotor near the tip of said rotor, with the tangential velocities of said fluid and said second rotor being normally nearly the same to avoid turbulence and turbulence related work losses. The fluid is then passed inward through the said second rotor where vanes 24 will assure that the fluid will rotate at the same speed as said second rotor for recovery of the work associated with the deceleration of said fluid within said second rotor. Said fluid is then discharged into said space 16 thus completing its cycle.

The function of the free vortex cavity will be further described: It is well known that a fluid passing along a curved path will have a higher pressure along the outer periphery of said path. The pressure increase for such situation is given by $$dp=\rho.V^2\,dr/r$$

and for a curved path, similar to that used in the device of this invention, the equation becomes $$P_2=P_1+ln\ (r_2/r_1)\ V^2w/144\ g$$

where $\rho$=fluid density, $r$ is radius, $V$=velocity along said curved path; $P_2$=pressure at outer periphery, $P_1$=pressure at inner periphery, $ln$=natural log., $r_2$=outer periphery radius, $r_1$=inner periphery radius, $w$=weight of fluid, 144=conversion factor, and $g$=acceleration of gravity. In the free vortex cavity, the fluid absolute tangential velocity would ordinarily change from a higher value to a lower value with increasing radius; but by using multiple nozzles feeding said cavity at different distances from center, the reduction in said absolute tangential velocity can be controlled or eliminated, as desired. Normally, the entry velocity of said fluid into said free vortex cavity is so controlled that the absolute tangential velocity of said fluid within said free vortex cavity 13 will remain constant, however, this is not mandatory. When said absolute tangential velocity is maintained constant within cavity 13, then the velocity V, in the second equation hereinbefore is the velocity within said cavity 13. In ordinary practice, the pressure $P_1$ shown in said second equation, is zero, but this is not mandatory. Normally, the exit velocities from nozzles 14 are so controlled as to obtain the desired total absolute tangential velocity for said fluid, and the absolute tangential velocity of said fluid and the tangential velocity of said rotor cavity 13 will coincide at the periphery of said cavity near entry to nozzles 12, so that turbulence losses are reduced. Thus, the differential between the tangential speeds of said fluid and said rotor is reduced with increasing radius, and finally at the cavity periphery both the fluid and the rotor will rotate at the same speed.

To improve the performance of this unit, the pressure within space 16 is increased to a higher value, above ambient air pressure. With suitable increase in operational rotor speed, the pressure $P_1$ can still be maintained zero, and a greater pressure increase within cavity 13 be effected. This in turn will increase the power output by the machine, by allowing the use of greater speeds for the said second rotor 11, these greater speeds having been made possible by the greater pressure differential available between nozzles 12 and the center space 16.

It should be noted that while the operation in cavities 15 and 24 are normal for centrifuges and for forced vortex flow, the operation in cavity 13 is defined by laws relating to free vortexes and this different form of operation is the basis for the workability of this power generator. In a free vortex, as operated herein, the pressure increase is much greater, than in a forced vortex rotating at similar speeds, and it is this increase in pressure within said free vortex that is employed to generate said power in the device of this invention.

It should be also noted that the temperature of the fluid is decreased while passing through the device, and to maintain the fluid temperature at a suitably constant level, heat is added to said fluid from an external source. Heat may be added in an external heat exchanger and the fluid circulated therethrough, or a heat exchanger be installed within the rotor with the heating fluid being circulated within such heat exchanger; such installation was described in my previous U.S. Pat. "Compressor with Cooling," No. 3,795,461.

The working fluid for the power generator of this invention may be a liquid or it may be a gas. Liquids such as water, or many of the halogenated hydrocarbons, or other liquids may be used. Various gases also may be used.

It should be noted that the fluid may be fed into said free vortex cavity from two sides; the unit shown in FIG. 1 has nozzles only on one side of said cavity 13. Arrangement where the feeding of fluid into cavity 13 from both sides as shown in my co-pending patent application "Turbine", filed Aug. 7, 1973, Ser. No. 386,273. Having said feed nozzles on both sides of cavity 13 will allow increase in the fluid flow within said cavity 13, and this in turn will reduce fluid friction effects on the fluid velocity within said cavity 13.

Another way that the effects of fluid friction within cavity 13 may also be reduced is by using heavy working fluid. The fluid enters said cavity 13 at a predetermined velocity, and use of heavy working fluid, such as many of the halogenated hydrocarbons, with their relatively low viscosity, will reduce the slowing down of said fluid within said cavity 13.

In normal operation, the unit requires a power transmission means for passing some of the power generated by said second rotor to drive said first rotor. Also, a means for starting the unit is required.

Applications include as a power generator for electricity generation, as a power source for portable uses, and as a power source for stationary uses.

Various controls and gauges may be required with the device of this invention; also, circulating pumps, and heat exchangers may be required. They are not a part of this invention and are not further described herein.

To further illustrate the construction of the unit of this invention, assume that the fluid is water. Assume that the angular speed of the first rotor is 250 rad/sec., and the cavity 13 inner radius is 1.1 inch and outer radius is 4.6 inch, and that the distance to first row of feeder nozzles is 1.9 inch, to second row of feeder nozzles is 2.7 inch, and the distance from center to third row of feeder nozzles is 3.6 inch. Then, the pressures due to rotation in cavity defined by vanes 15 are: At first row, 10 psi, at second row, 21 psi, at third row, 38 psi. The tangential speed at nozzles 12 is 95 fps., and the required fluid tangential total velocities are 95 fps at nozzles 12, 121 fps at third row, 127 fps at second row and 135 fps at first row of feeder nozzles. Setting flow at 10 lbs/sec from first and second row nozzles, and 14 lbs/sec from third row nozzles, the adjusted absolute fluid tangential velocities then become 141 fps first row, 166 fps at second row and 165 fps at third row nozzles within cavity 13. Cavity pressure is then 213 psia at nozzles 12, and 0 psia at inner cavity radius. Actual exit velocities for the fluid from feeder nozzles are, after corrections, 142 fps for first row, 116 fps at second row, and 79 fps at third row; the corresponding fluid absolute velocities are then 176 fps at first row, within cavity 13, and 167 fps at second row and 151 fps at third row within cavity 13. Thus, for this device, the pressure of water at entry to nozzles 12 is 213 psia; for comparison, note that for a centrifuge, the water pressure for tangential speed 95 fps is 62 psia. This is the reason for the functioning of the power generator of this invention. The work input to first rotor, relating to reaction in feeder nozzles and at nozzles 12, is 0.42 BTU/lb, and work output from second rotor is 0.45 BTU/lb, with second rotor rotating at 107 fps tip speed. The pressure at exit side of nozzles 12 is 212 psia. Work output can be increased by pressurizing the system with gas, and increasing the rotor speeds. All values shown are approximate.

I claim:

1. A power generator comprising:

a. a support for supporting a shaft;

b. a shaft journalled in bearings in said support for rotation;

c. a rotating first rotor mounted on said shaft so as to rotate in unison therewith; said rotor being hollow for circulating a fluid therewithin; said rotor having a first cavity near the center of said rotor adapted for passing said fluid and connected with a second cavity extending outward from the center of said rotor; said second cavity having vanes therewithin for assuring that said fluid will rotate with said rotor for acceleration of said fluid for pressurization of said fluid; said second cavity having a plurality of discharge nozzles for passing said fluid into a third cavity, said third cavity being a cavity for forming a free vortex by said fluid; said second cavity discharge nozzles being located a predetermined distance away from the center of rotation of said rotor; said second cavity discharge nozzles being sized and shaped to obtain highest attainable exit velocity for said fluid from said nozzles for the pressure differential available between entry and exit ends of said discharge nozzles; said second cavity discharge nozzles being oriented to discharge said fluid in nearly tangentially forward direction that is in the direction of rotation of said first rotor; said fluid being pressurized within said third cavity by being forced to follow a curved path formed by said third cavity, with the highest fluid pressure existing at the radial distance furthest away from the center of rotation of said rotor; said fluid being then passed to exit nozzles from said third cavity with said exit nozzles being located near the periphery of said third cavity and with said exit nozzles being oriented to discharge said fluid in forward direction that is in the direction of rotation; said fluid being at a higher pressure at the entry to said third cavity exit nozzles than at the entry to said first cavity;

d. a second rotor for generating power and being rotatably mounted and supported by a shaft and bearings; said second rotor cavity at periphery being adjacent to said first rotor third cavity exit nozzles for receiving said fluid; said fluid being passed inward toward the center of rotation via inward extending fluid passageways with said inward extending fluid passageways being provided with vanes for assuring that said fluid will rotate with said second rotor and for recovery of the work associated with the deceleration of said fluid; said second rotor being sealed with said first rotor for retention of pressure of said fluid; said fluid being discharged from said second rotor near the rotor center with said fluid being passed into said first rotor first cavity;

e. a means for adding heat to said fluid.

2. The power generator of claim 1 wherein said means for adding heat to said fluid comprises passages communicating with said first rotor cavity for passing heated fluid from an external source and for withdrawing fluid from said first rotor cavity.

3. The power generator of claim 1 wherein said second cavity discharge nozzles are arranged in plurality of rows with each row a different distance away from rotor center for improving the velocity distribution within said first rotor third cavity, for a greater pressure increase of said fluid within said third cavity.

4. The power generator of claim 1 wherein said second rotor is surrounded by an extension of said first rotor for pressure retention and a seal is provided about the shaft of said second rotor.

5. A power generator comprising:

a first rotor including;

an axially extending cavity therewithin, a first radially extending annular cavity having vanes therein, said radially extending cavity being in communicataion with said axial cavity, a second radially extending annular cavity, the same being so configured as to permit the forming of a free vortex therewithin, a plurality of nozzle means communicating between said first and second radially extending cavities, third radially extending annular cavity for receiving a further rotor therewithin;

a second rotor including;

a vane-containing hollow portion, said hollow portion being in communication with said first rotor's axial cavity, and a shaft portion, said first rotor further including means for rotataly receiving said second rotor shaft, and nozzle means for communicating between said third radially extending cavity of said first rotor and said second rotor's hollow portion.

6. The device of claim 1 and including conduit means for permitting fluid to enter and exit from said axially extending first rotor cavity.

* * * * *